United States Patent [19]

Norton

[11] Patent Number: 4,881,653

[45] Date of Patent: Nov. 21, 1989

[54] COMPRESSOR

[75] Inventor: Allen R. Norton, Great Valley, N.Y.

[73] Assignee: American Locker Group Incorporated, Jamestown, N.Y.

[21] Appl. No.: 217,437

[22] Filed: Jul. 11, 1988

[51] Int. Cl.[4] ..... A47B 63/00; A47B 88/00

[52] U.S. Cl. ..... 220/22.3; 206/425; 206/556; 211/51; 220/22.5

[58] Field of Search ..... 206/425, 556; 220/22.1, 220/22.2, 22.3, 22.4, 22.5, 22.6; 211/45, 46, 51, 59.3, 175; 312/185, 187, 189

[56] References Cited

U.S. PATENT DOCUMENTS

| | | | |
|---|---|---|---|
| 202,732 | 4/1878 | Lees . | |
| 487,230 | 11/1892 | Ohmer . | |
| 860,223 | 7/1907 | Marshall . | |
| 1,061,463 | 5/1913 | Fraser . | |
| 1,314,687 | 9/1919 | Miller . | |
| 1,367,245 | 2/1921 | Ebrenz . | |
| 1,605,581 | 11/1926 | Heath . | |
| 1,910,689 | 5/1933 | Gronberg et al. . | |
| 2,043,323 | 6/1936 | Gourley et al. . | |
| 2,081,470 | 5/1937 | Vanderhoof . | |
| 2,110,185 | 3/1938 | Weesies . | |
| 2,256,351 | 9/1941 | Regenhardt | 220/22.5 |
| 2,256,352 | 9/1941 | Regenhardt | 220/22.5 |
| 2,271,678 | 2/1942 | Burdick . | |
| 2,557,915 | 6/1951 | Regenhardt . | |
| 2,560,428 | 7/1951 | Fosberg . | |
| 2,585,612 | 2/1952 | Abrahamson . | |
| 2,630,219 | 3/1953 | Pierce | 206/74 |
| 2,689,573 | 9/1954 | Foehrenbach . | |
| 2,758,602 | 8/1956 | Anderson | 220/22.3 |
| 2,793,643 | 5/1957 | Wolters | 220/22.3 |
| 2,850,017 | 9/1958 | Anderson | 220/22.3 |
| 2,919,966 | 1/1960 | Preston | 312/27 |
| 3,057,358 | 10/1962 | Bergman | 220/22.3 |
| 3,109,432 | 11/1963 | Regenhardt . | |
| 4,067,630 | 1/1978 | Stark et al. | 312/319 |
| 4,113,108 | 9/1978 | Anderson | 211/43 |

*Primary Examiner*—George L. Walton

*Attorney, Agent, or Firm*—Bean, Kauffman & Spencer

[57] ABSTRACT

A filing unit includes a drawer and a compressor mounted by the drawer for sliding movement lengthwise thereof between drawer contents compressing and released positions and for pivotal movement for purposes of releasably locking the compressor in a desired position lengthwise of said drawer.

13 Claims, 2 Drawing Sheets

Fig. 1.
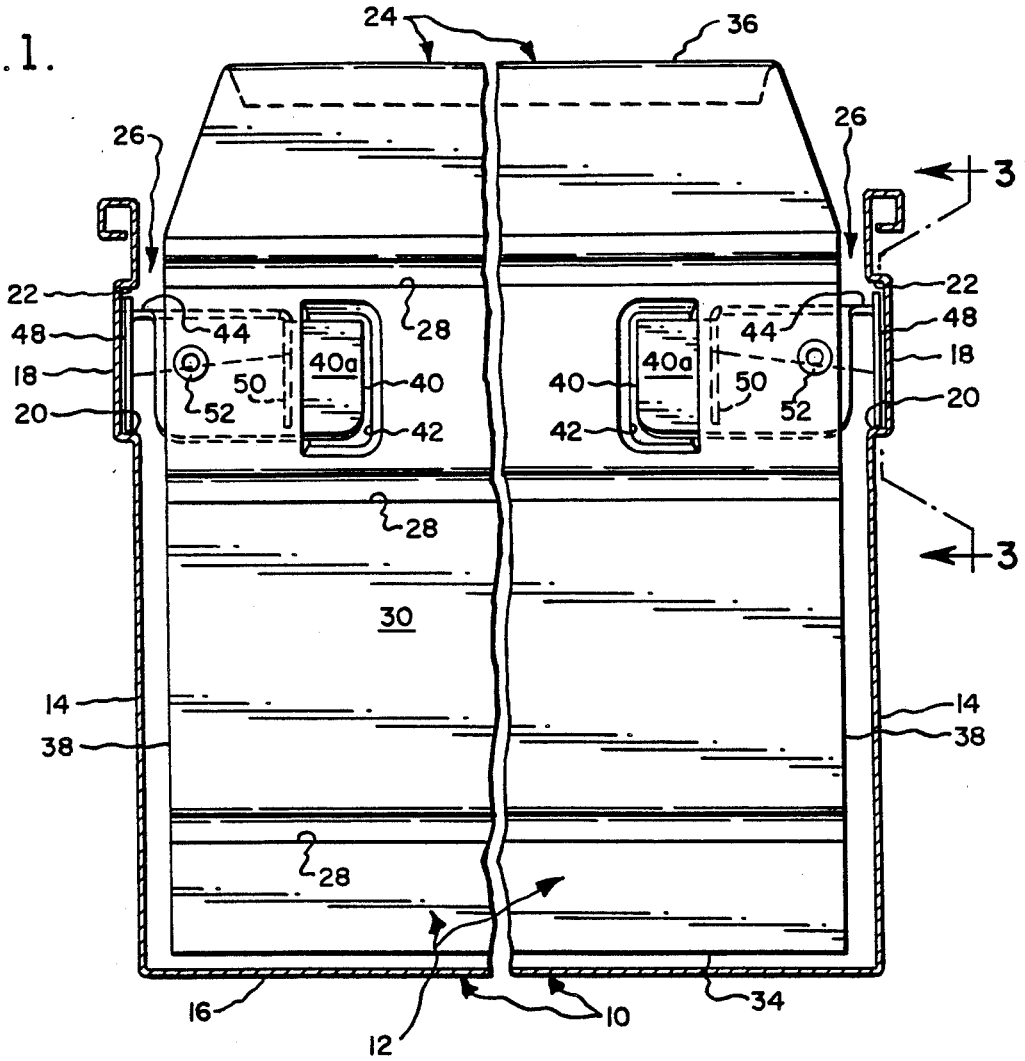
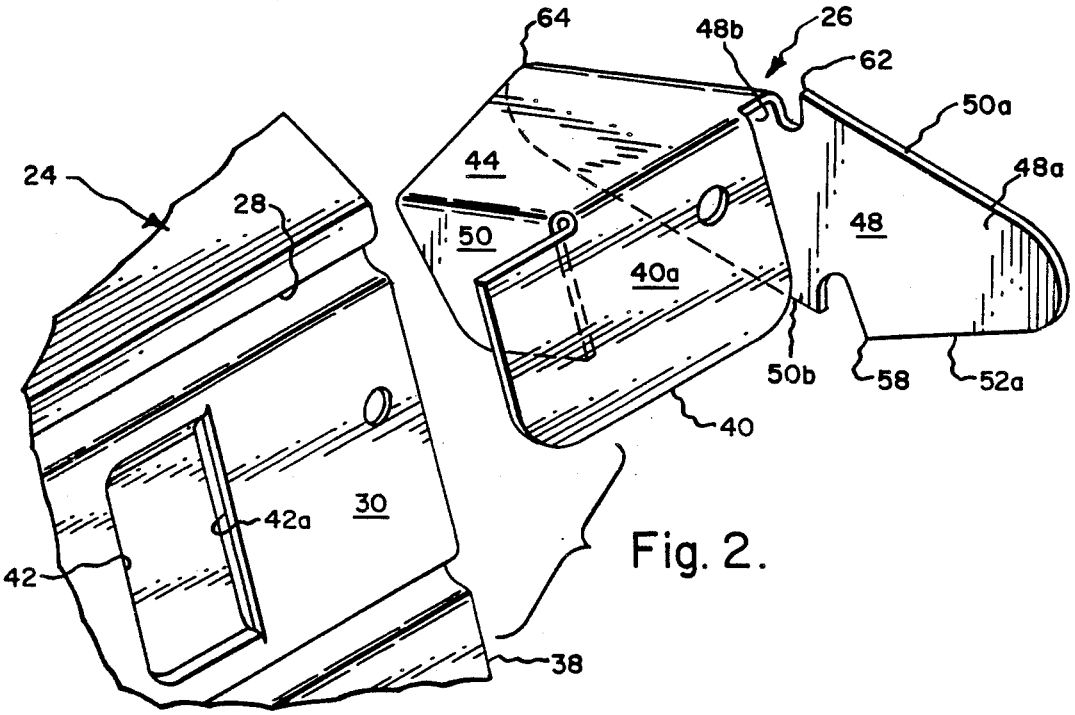
Fig. 2.

COMPRESSOR

BACKGROUND OF THE INVENTION

The present invention relates to filing units of the type comprising a drawer and a compressor for releasably retaining drawer contents in a compressed, upstanding condition within the drawer.

Heretofore, it has been conventional commercial practice to provide a compressor with guide means to support the compressor for sliding movements lengthwise of the drawer between drawer contents compressing and release positions and a separate, manually operable locking means for releasably locking the compressor in a desired position lengthwise within the drawer.

However, it has also been proposed, as evidenced by U.S. Pat. Nos. 2,166,026 and 3,109,432 to provide a compressor with one-piece guide means, which serves to both support and releasably retain the compressor in a desired position within a drawer. However, in U.S. Pat. No. 2,166,026, the guide means is not capable of positively locking the compressor in a desired adjusted position and in U.S. Pat. No. 3,109,432, the guide means is not capable of both automatically locking the compressor in a desired position in response to force exerted thereon by contents of a file drawer, as an incident to placement of the compressor in such position, and positively releasably locking the compressor within the file drawer in any position into which the compressor is moved.

SUMMARY OF THE INVENTION

The present invention is directed to filing units of the type comprising a file drawer and a compressor for releasably retaining drawer contents in a compressed upstanding condition within the drawer.

More particularly, the present invention relates to an improved compressor having guide means serving to cooperate with guide channels defined by the drawer for purposes of slidably supporting the compressor for movement lengthwise within the drawer and for releasably retaining the compressor in any desired position.

The present invention features guide means, which are unique from the standpoint that they are of one-piece construction and designed to assume three distinct positions relative to the drawer guide channels, namely, a first position in which they serve to slidably support the compressor; a second or temporary locked position which they tend to assume incident to manual placement thereof in compressing engagement with the contents of the drawer; and a third or positively locked position into which they may be manually moved at any point lengthwise within the drawer. The guide means may be selectively removed from their second and third positions by the application of manual pressure thereto.

BRIEF DESCRIPTION OF THE DRAWINGS

The nature and mode of operation of the present invention will now be more fully described in the following detailed description taken with the accompanying drawings wherein:

FIG. 1 is a fragmentary sectional view taken transversely through a filing unit of the present invention;

FIG. 2 is an enlarged, fragmentary and exploded perspective view of the compressor of the filing unit.

DETAILED DESCRIPTION

Figure 3:
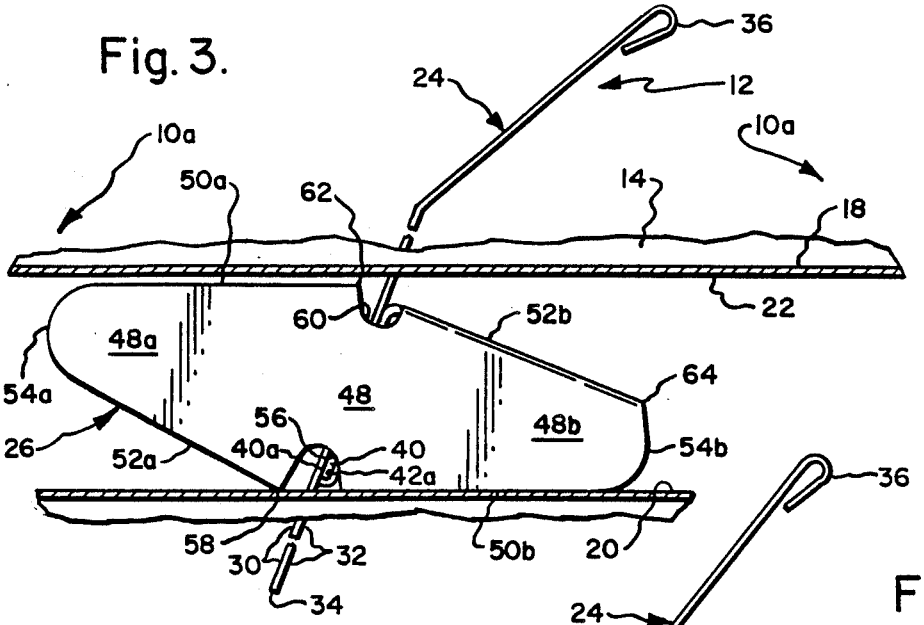
FIGS. 3–5 are sectional views taken generally along the line 3—3 in FIG. 1, showing the compressor in its first, second and third positions, respectively.

Reference is first made to FIG. 1, wherein there is illustrated a filing device comprising a file drawer 10 and a compressor 12 movably supported by the drawer for purposes of releasably retaining drawer contents, such as files or individual paper sheets, in a compressed, generally upstanding position within the drawer.

Drawer 10 is of conventional construction from the standpoint that it includes a pair of generally parallel side walls 14 and 14, which upstand from a bottom wall 16, and drawer front and rear walls, not shown. Side walls 14 and 14 support a pair of generally U-shaped guide channels 18 and 18, which open towards one another, extend lengthwise of drawer 10 intermediate its front and rear walls and define essentially parallel lower and upper guide surfaces 20 and 22, respectively. Guide channels 18 and 18 may be formed integrally with side walls 14 and 14, as depicted in FIG. 1, or formed by separate channel members, not shown, suitably affixed to such side walls. In either case, the material chosen to form the guide channels is preferably resiliently deformable at least in part, as required to permit slight separating movement of guide surfaces 20 and 22 for the reason to be described. Drawer 10 is preferably of sheet metal construction.

Compressor 12 is shown in the drawings as being in the form of a generally rectangular compressor plate 24 and a pair of mirror image guides 26 and 26, which are adapted to be received one within each of guide channels 18 and 18 for purposes of supporting the compressor plate to extend transversely within drawer 10 and for forwardly and rearwardly directed movements lengthwise thereof. Compressor plate 24 may be of thin metal or plastic sheet construction, which may be rigidified by the provision of a suitable member of transversely extending reinforcing or stiffening ribs 28. Compressor plate 24 may be considered as having forwardly and rearwardly facing surfaces 30 and 32, lower and upper edges 34 and 36, and opposite side edges 38 and 38. The arrangement is such that, when the compressor plate is supported within drawer 10 in the manner generally depicted in the drawings, the opposite side edges are spaced inwardly of side walls 14 and 14 and the lower edge is spaced above bottom wall 16 sufficiently to permit free movement of the compressor lengthwise within drawer 10, and the upper edge is normally arranged above the level of materials intended to be filed within the drawer to facilitate gripping of the compressor plate by a user for purposes of releasably locking the compressor in a selected position within the drawer.

To facilitate description of the invention, only the right hand guide 26, as viewed in FIG. 1, and its mode of attachment to compressor plate 24, will be described with reference to FIGS. 1–5 and like numerals will be employed to designate like elements of the left hand guide viewable in FIG. 1.

First referring to FIGS. 1 and 2, it will be understood that each guide 26 is preferably of one-piece stamped sheet metal construction and shaped to define a generally rectangular mounting flange 40, which is sized for receipt within a forwardly facing mounting recess 42 of compressor plate 24 via a slot insertion opening **42*a* shown in FIG. 2; a connector flange 44, which is fixed to the mounting flange to extend rearwardly thereof; a guide flange 48, which depends from the outer edge of the connector flange; and a bracing flange 50**, which depends from an inner edge of the connector flange for engagement with the rear surface of the mounting flange outwardly of the mounting recess.

Guide 26 is suitably secured to compressor plate 24 after positioning of mounting flange 40 within mounting recess 42, such as by rivet device 52. With guides 26 so mounted, their guide flanges 48 and 48 are disposed in a parallel relationship and in an outwardly spaced relationship relative to their associated compressor plate side edges 38 and 38, as shown in FIG. 1.

Figure 4:
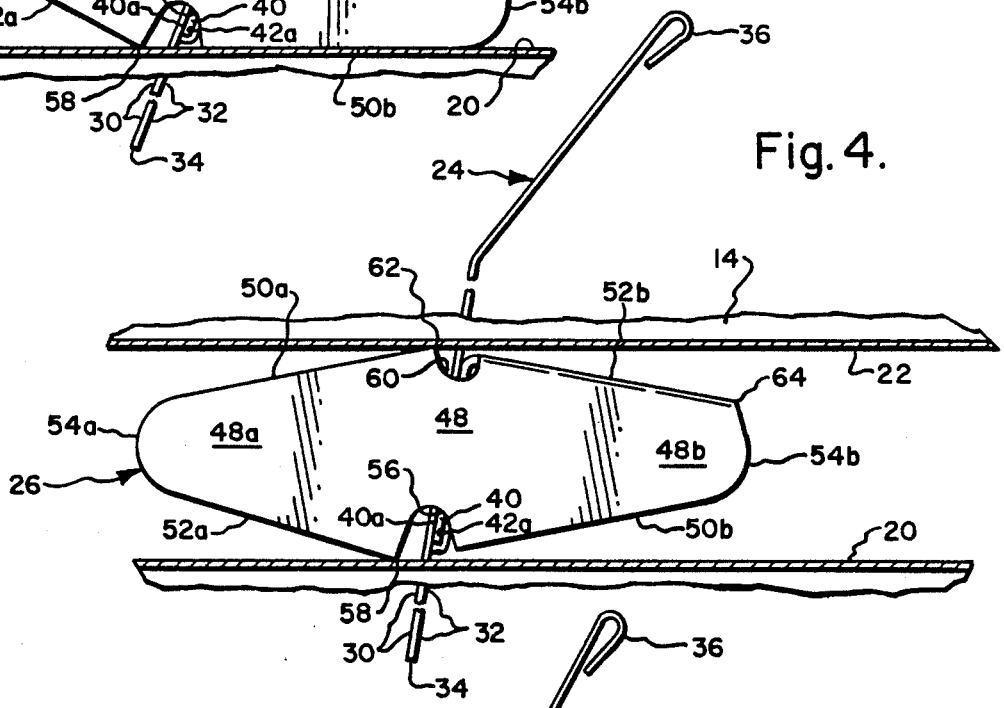
Figure 5:
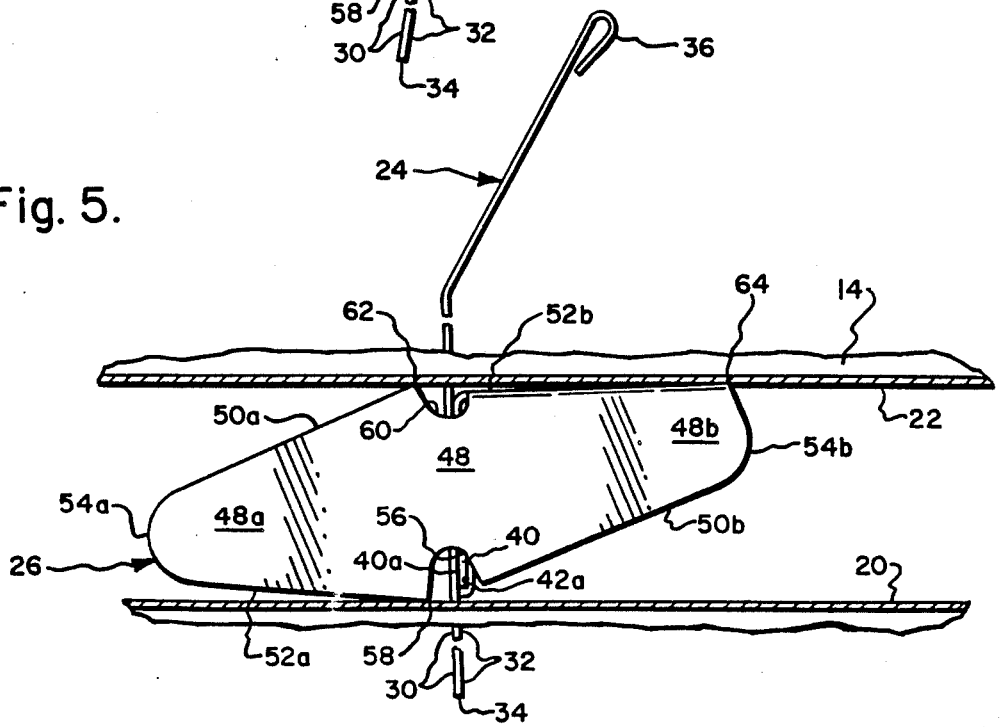

Guide flange 48 is best shown in FIGS. 3–5 as having front and rear flange parts or wings 48*a* and 48*b*, which are arranged to project forwardly and rearwardly of compressor plate surfaces 30 and 32, respectively; front and rear end portions of drawer 10 being generally designated as 10*a* and 10*b*, respectively, in FIG. 3 for purposes of reference. Flange parts 48*a* and 48*b* serve to define essentially parallel upper and lower guide surfaces 50*a* and 50*b*, lower and upper clearance surfaces 52*a* and 52*b*, and generally rounded end surfaces 54*a* and 54*b* serving to join the forwardly and rearwardly extending ends of their respective guide and clearance surfaces. Guide flange 48 is cut away at 56 for purposes of cooperating with the rearwardly disposed end of lower clearance surface 52*a* to define a lower latching tooth 58 and at 60 for purposes of cooperating with the rearwardly disposed end of upper guide surface 50*a* to define an upper latching tooth 62. Preferably, the tip or outer end of lower tooth 58 is disposed essentially flush with or slightly recessed relative to lower guide surface 50*b*, and upper clearance surface 52*b* is arranged such that it is recessed relative to a line drawn between the tip or outer end of upper tooth 62 and an abutment 64 defined by the juncture of the rearwardly disposed end of the upper clearance surface and end surface 54*b*.

The forwardly facing surface 40*a* of mounting flange 40, which is intended to be disposed essentially flush with rearwardly facing surface 32 of compressor plate 24, lies within a plane forming an angle of about 69° with guide surfaces 50*a* and 50*b*. Teeth 58 and 62 in turn lie within a plane, which is disposed forwardly of and essentially parallel to the front surface 40*a*. Thus, teeth 58 and 62 are disposed on opposite sides of a line drawn normal to guide surfaces 50*a* and 50*b*, and as such the distance between the tips of the teeth is greater than the distance between the guide surfaces. It is critical to the practice of the present invention that the normal spacing between channel guide surfaces 20 and 22 be slightly greater than the spacing between guide surfaces 50*a* and 50*b*, but slightly less than the spacing between the tips of teeth 58 and 62, and that the spacing between the channel guide surfaces and the degree of resiliency of channels 18 be such as will allow over-center movement of tooth 62 relative to tooth 58 incident to pivotal movements of compressor 12 relative to drawer 10 in the manner to be described.

Reference is now made specifically to FIG. 3, wherein compressor 12 is shown as being in a first position, which it tends to assume under the influence of gravity when no other external force is applied thereto. In this position, the relative orientation and weight distribution of compressor plate 24 and guides 26 and 26 is such that compressor 12 is supported by surface to surface engagement of guide surface(s) 50*b* with channel lower guide surface(s) 20 to allow a user to freely slide the compressor forwardly and rearwardly within drawer 10 and the compressor plate is inclined to extend upwardly and rearwardly within the drawer at an angle of about 69° relative to the channel lower guide surface.

FIG. 4 illustrates a second position of compressor 12, which tends to occur as an incident to movement of the compressor under the control of a user forwardly within drawer 10 sufficiently to compress or contain drawer contents, such as files or papers, not shown, disposed between compressor plate front surface 30 and the front wall of such drawer. More specifically, as the drawer contents are compressed, they establish a force opposing continued forwardly directed sliding movement of compressor 12. This force tends to act on front surface 30 adjacent compressor plate lower edge 34, which leads in the direction of sliding movement of compressor 12, with the result that movement of such lower edge is eventually arrested and the compressor thereafter caused to pivot about a pivot point defined by lower tooth 58, as the user continues to apply force to rear surface 32 of compressor plate 24 adjacent upper edge 36, until upper tooth 62 is eventually brought into frictional surface engagement with channel upper guide surface 22. Thereafter, when a user releases the forwardly directed pressure applied to compressor plate 24, the weight of the compressed files acting against front surface 30 tends to retain teeth 58 and 62 frictionally engaged with channel guide surfaces 20 and 22 for purposes of preventing rearwardly directed movement of the compressor until subsequently released by a user. A user may release compressor 12 from its temporarily locking position shown in FIG. 4 by exerting force against the upper portion of front surface 30 in order to pivot the compressor in a clockwise direction about the pivot defined by lower tooth 58, sufficiently to remove upper tooth 62 from frictional engagement with channel guide surface 22 and thus free the compressor for rearwardly directed movement within the drawer. The previously referred to resiliency of guide channels 18 and 18 permits a slight spreading apart of guide surfaces 20 and 22, as an incident to movement of compressor 12 into its illustrated, temporarily locked position, whereby the resultant return bias tends to increase the frictional forces acting between teeth 58 and 62 and guide surfaces 20 and 22 for purposes of assisting in retaining the compressor in such locked position.

FIG. 5 illustrates a third or positively locked position of compressor 12, which is achieved by user induced counter-clockwise directed pivotal movement of compressor 12 past its temporarily locked position shown in FIG. 4. During such movement, the resilient nature of guide channels 18 and 18 allows spreading of guide surfaces 20 and 22 sufficiently to permit upper tooth 62 to pass over center relative to lower tooth 58; the extent of pivotal movement of compressor 12 being limited or determined by engagement of abutment 64 with the channel upper guide surface 22. A user may remove compressor 12 from its positively locked position for return to its temporarily locked position of FIG. 4 by applying sufficient pressure to compressor plate 24 adjacent its upper edge 36 to cause same to pivot in a clockwise direction about lower tooth 58.

What is claimed is:

1. A filing device comprising a drawer for receiving contents to be filed, said drawer having a pair of guide channels defining essentially parallel upper and lower channel guide surfaces arranged to extend lengthwise of said drawer and normally being spaced apart through a first distance; and a compressor, said compressor having a compressor plate and a pair of guide means fixed to said compressor plate and arranged in association one with each of said guide channels to support said compressor plate to extend transversely of said drawer between said guide channels and for movement lengthwise within said drawer, each said guide means having essentially parallel upper and lower guide surfaces arranged in facing relation with said upper and lower channel guide surfaces, respectively, with which said guide means is associated and having a spacing therebetween less than said first distance, an upper tooth, a lower tooth spaced from said upper tooth through a distance exceeding said first distance, and abutment means, at least one of said guide channels and said guide means being formed at least in part of resiliently deformable material to permit the upper teeth of said guide means to pass through an over center position relative to the lower teeth of said guide means as an incident to manually effected pivotal movement of said compressor relative to said drawer about a pivot axis defined by engagement of the lower teeth with said lower channel guide surfaces, from a first position defined by surface engagement of said lower guide surfaces with said lower channel guide surfaces into a further position defined by surface engagement of said abutment means with said upper channel guide surfaces, said compressor when in said first position being supported by said guide channels for sliding movement lengthwise of said drawer and when in said further position being constrained by said guide channels against movement lengthwise of said drawer.

2. A filing device according to claim 1, wherein said compressor plate is disposed to incline upwardly and rearwardly and upwardly and forwardly relative to said drawer when in said first and further positions, respectively.

3. A filing device according to claim 1, wherein said upper and lower teeth lie within a plane disposed forwardly of and essentially parallel to said compressor plate.

4. A filing device according to claim 1, wherein said upper and lower teeth are disposed forwardly of said compressor plate and on opposite sides of a line disposed normal to said upper and lower guide surfaces, and said compressor plate is disposed to incline upwardly and rearwardly relative to said drawer when in said first position thereof.

5. A filing device according to claim 1, wherein said guide channels are formed of resiliently deformable material.

6. A filing device according to claim 5, wherein said upper teeth are arranged to engage with said upper channel guide surfaces incident to said pivotal movement of said compressor from said first position to define a temporarily locked position of said compressor, wherein said compressor is frictionally locked against movement rearwardly relative to said drawer by simultaneous frictional engagement of said upper and lower teeth with said upper and lower channel guide surfaces, respectively, said compressor plate is diposed to incline upwardly and rearwardly relative to said drawer in both said first and temporarily locked positions and said contents of said drawer when compressed by movement of said compressor into engagement therewith tend to bear on said compressor plate and maintain said compressor in said temporarily locked position.

7. A filing device comprising a drawer for receiving contents to be filed, said drawer having front and rear end portions and a pair of facing guide channels defining essentially parallel upper and lower channel guide surfaces arranged to extend lengthwise of said drawer intermediate said end portions and spaced through a first distance, said guide channels being formed at least in part of a resiliently deformable material allowing said channel guide surfaces to assume a spacing therebetween greater than said first distance against a return bias; and a compressor, said compressor having a compressor plate and a pair of guide means fixed to said compressor plate and arranged in association one with each of said guide channels for supporting said compressor plate to extend transversely of said drawer between said guide channels and for movement lengthwise of said drawer for releasably compressing said contents intermediate said compressor plate and said front end portion, said guide means cooperating with said lower channel guide surfaces to define pivot means for supporting said compressor for pivotal movement relative to said drawer from a first pivotal position in which said guide means engages with said lower channel guide surfaces to support said compressor for sliding movement lengthwise of said drawer with said compressor plate being disposed to incline upwardly and rearwardly relative to said drawer into a second pivotal position, wherein said guide means engages with said upper and lower channel guide surfaces to effect movement of said channel guide surfaces away from one another against said bias and to frictionally oppose movement of said compressor within said drawer towards said rear end portion, said compressor plate being disposed to incline upwardly and rearwardly relative to said drawer when in said second pivotal position.

8. A filing device comprising a drawer for receiving contents to be filed, said drawer having front and rear end portions and a pair of facing guide channels defining essentially parallel upper and lower channel guide surfaces arranged to extend lengthwise of said drawer and spaced from one another through a first distance, at least a portion of said guide channels being formed of a resiliently deformable material to allow said upper and lower channel guide surfaces to be spread apart under a return bias; and a compressor, said compressor having a compressor plate having front and rear surfaces and a pair of guide means fixed to said compressor plate and arranged in association one with each of said guide channels for supporting said compressor plate to extend transversely of said drawer between said guide channels and for movement lengthwise of said drawer for releasably retaining said contents in a compressed condition immediate said compressor plate and said front end portion of said drawer, each said guide means including a guide flange disposed to extend essentially normal to said compressor plate and defining upper and lower guide surfaces, respectively, having a spacing therebetween less than said first distance and arranged for slidable engagement with said channel upper and lower guide surfaces to guide said compressor for sliding movement lengthwise within said drawer, said guide flange having an abutment and upper and lower locking teeth having a spacing therebetween exceeding said first distance, said lower locking teeth being arranged to engage with said channel lower guide surfaces to define a pivot about which said compressor may be pivoted within said drawer from a first position in which said lower guide surfaces are disposed for sliding engagement with said channel lower guide surfaces and a locked position in which said upper and lower locking teeth are disposed in frictional engagement with said channel upper and lower guide surfaces and said abutment is disposed in abutting engagement with said channel upper guide surface, said upper locking teeth passing overcenter relative to said lower locking teeth incident to pivotal movement of said compressor between said first and locked positions against said return bias.

9. A filing device according to claim 8, wherein said compressor plate is supported by said guide flange to incline upwardly and rearwardly relative to said drawer when in said first position and upwardly and forwardly within said drawer when in said locked position.

10. A filing device according to claim 8, wherein said compressor plate is formed with a pair of forwardly opening mounting recesses and a pair of oppositely facing access slots associated one with each of said mounting recesses for affording access to its associated one of said mounting recesses from adjacent said rear surface of said compressor plate, and each of said guide means includes a mounting flange sized to be inserted through one of said access slots for receipt within its associated one of said mounting recesses.

11. A filing device according to claim 10, wherein said guide means additionally includes a bridging flange joined to said mounting flange and arranged to extend rearwardly of said compressor plate and transversely of said drawer, said guide flange is joined to said bridging flange outwardly of said compressor plate, and a bracing flange is joined to said bridging flange and arranged for engagement with said mounting plate.

12. A filing device according to claim 8, wherein said compressor plate extends upwardly and rearwardly within said drawer when in said first position, and said upper and lower locking teeth are disposed rearwardly and forwardly of a line drawn normal to said lower guide surface.

13. A filing device according to claim 8, wherein said guide flange has first and second parts disposed to extend forwardly and rearwardly of said front and rear surfaces of said compressor plate, said first and second parts defining said upper and lower guide surfaces, respectively, said first part defining said upper and lower teeth, said second part defining said abutment, and said upper and lower teeth are disposed forwardly of said front surface of said compressor plate and arranged rearwardly and forwardly, respectively, of a line drawn normal to said lower guide surface.

* * * * *